US006178979B1

(12) United States Patent
Galloway

(10) Patent No.: US 6,178,979 B1
(45) Date of Patent: Jan. 30, 2001

(54) TABLE SCREEN

(76) Inventor: Sandra L. Galloway, 939 Top View Dr., Edgewood, MD (US) 21040

( * ) Notice: Under 35 U.S.C. 154(b), the term of this patent shall be extended for 0 days.

(21) Appl. No.: 09/212,987

(22) Filed: Dec. 16, 1998

(51) Int. Cl.[7] ..... E04H 15/26; A47B 13/08

(52) U.S. Cl. ..... 135/99; 135/96; 135/913; 108/50.12; 108/90; 150/158

(58) Field of Search ..... 135/15.1, 16, 33.2, 135/33.5, 90, 96, 98, 99, 100, 913; 108/50.11–50.13, 90, 161; 150/154, 158

(56) References Cited

U.S. PATENT DOCUMENTS

| | | | | |
|---|---|---|---|---|
| 148,569 | * | 3/1874 | Ladd | 135/99 X |
| D. 282,788 | | 3/1986 | Svanberg | D8/1 |
| 788,351 | * | 4/1905 | Burrell | 135/124 X |
| 814,473 | | 3/1906 | Patterson . | |
| 2,943,634 | | 7/1960 | Morgan . | |
| 3,279,515 | * | 10/1966 | Kesh | 108/90 X |
| 3,295,577 | * | 1/1967 | Danielson | 108/90 X |
| 3,477,453 | | 11/1969 | D'Ulisse et al. | 135/2 |
| 3,782,435 | * | 1/1974 | Sherman | 135/16 |
| 3,860,022 | | 1/1975 | Amdt et al. | 135/2 |
| 3,899,168 | * | 8/1975 | Besherse | 135/96 X |
| 4,154,255 | | 5/1979 | Weaver | 135/16 |
| 5,050,654 | * | 9/1991 | Howell et al. | 150/158 |
| 5,172,712 | | 12/1992 | Robinson | 135/98 |
| 5,664,595 | | 9/1997 | Vonderhorst et al. | 135/16 |
| 5,678,587 | | 10/1997 | Bilotti | 135/98 |
| 5,694,866 | * | 12/1997 | Muller | 108/90 X |
| 6,014,935 | * | 1/2000 | Willett | 108/90 |

* cited by examiner

*Primary Examiner*—Carl D. Friedman
*Assistant Examiner*—Winnie Yip
(74) *Attorney, Agent, or Firm*—Larry J. Guffey

(57) ABSTRACT

A flexible, collapsible screen for protecting outdoor table tops from bugs and flying insects is disclosed. In a preferred embodiment for use with a table having a central, vertical pole, it comprises: (a) a flexible, open screen material having a central aperture sized to fit around the pole, with the screen's outer perimeter sized so that its perimeter extends beyond the table top's outer edges, (b) a strip, located on the perimeter of screening material's central aperture, of hook and loop receiving material, with a hook and loop attaching patch on the opposite side of the strip so that the size of the aperture can be contracted so as to secure the center of the screen material to the pole at a fixed height above the table top, (c) a plurality of hook and loop attaching patches located on the outer perimeter of the screen material and (d) a plurality of table patches, each of which has a side for securing the patch to the table top, while the other side has a hook and loop receiving portion which allows the patches on the screen material's outer perimeter to be adhered to the patches affixed to the table top.

15 Claims, 2 Drawing Sheets

TABLE SCREEN

BACKGROUND OF THE INVENTION

1. Field of the Invention

The present invention generally relates to outdoor furniture accessories. More particularly, this invention relates to collapsible screens for protecting outdoor table tops from bugs and flying insects.

2. Description of the Related Art

It has long been a problem to keep bugs and insects away from food and other matter placed on the tops of outdoor tables. Many types of portable shelters have been proposed for remedying this problem.

For example, U.S. Pat. Nos. 814,473, 2,943,634, 3,477,453, 3,860,022, 5,172,712, and 5,678,587 all reveal various types of flexible screening that is generally supported from the perimeter of an umbrellas that extends above the table top to be protected. These types of screening devices all protect a much larger volume of space than the area immediately above the table top, and consequently have a number of disadvantages. For example, they all required excessive amounts of screening material and the resulting devices can be comparatively difficult and time-consuming to erect.

Despite this prior art, there still exists a need for small, easily portable and easily erectable screening devices to keep bugs and insects away from food and other matter placed on the tops of outdoor tables.

SUMMARY OF THE INVENTION

The present invention is generally directed to satisfying the needs set forth above and the problems identified in the prior arts. The problem of having to transport and erect bulky, difficult-to-install screening devices to protect the material on the tops of outdoor tables is resolved by the present invention.

In accordance with one preferred embodiment of the present invention, the foregoing need can be satisfied by providing a table screen, for use with a table top having a pole extending vertically from the center of the table, comprising: (a) a flexible, open screen material having a central aperture sized to fit around the pole, with the screen's outer perimeter sized so that its perimeter extends beyond the table top's outer edges, (b) a strip, located on the perimeter of screening material's central aperture, of Velcro-like, hook and loop receiving material, with a Velcro-like, hook and loop attaching patch on the opposite side of the strip so that the size of the aperture can be contracted so as to secure the screen material to the pole at a fixed height above the table top, (c) a plurality of Velcro-like, hook and loop attaching patches located on the outer perimeter of the screen material and (d) a plurality of table patches, each of which has a side for securing the patch to the table top, while the other side has a Velcro-like, hook and loop receiving portion which allows the patches on the screen material's outer perimeter to be adhered to the patches affixed to the table top.

In another preferred embodiment, wherein the table does not have a pole extending vertically from the table, the present invention further includes: (1) a pole having a first end and a second end, and (2) means, affixed proximate first pole end, for securing the first pole end to the table top so that the second pole end is extended vertically from the table top.

In another preferred embodiment, the present invention is seen to take the form of a method for screening a table top having a pole extending vertically from the table, the method comprising the steps of (1) providing a table screen as initially described above, (2) fixing the screen material's central aperture at a height above the table top so as to define a storage space between the table top and the bottom side of the screen material, (3) adhering the bottom sides of the table patches to the table top, and (4) bringing the Velcro-like, hook and loop attaching patches, located on the outer perimeter of the screen material, into contact with the Velcro-like, hook and loop receiving, top sides of the table patches so as to secure the outer perimeter of the screen material to the table top.

This new and improved, table screen and table screening method are seen to achieve their object of providing small, easily portable and easily erectable screening devices and methods for keeping bugs and insects away from food and other matter placed on the tops of outdoor tables.

Other objects and advantages of this invention will become readily apparent as the invention is better understood by reference to the accompanying drawings and the detailed description that follows.

DESCRIPTION OF THE PREFERRED EMBODIMENT

Figure 1:
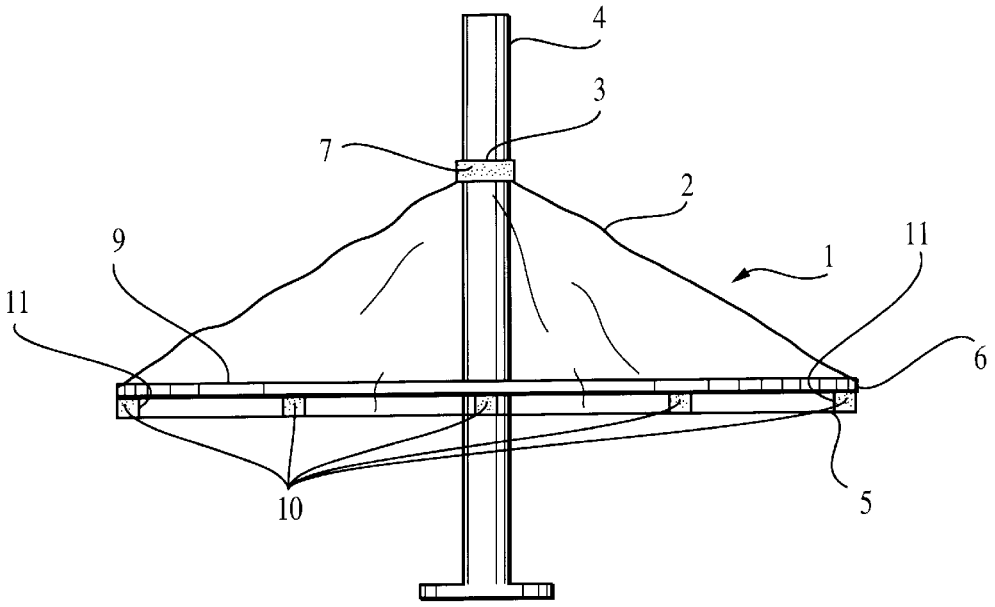
FIG. 1 is a side view showing one embodiment of the present invention being used with a round table top having a pole extending vertically from the center of the table top to-be-screened.

Referring now to the drawings wherein are shown preferred embodiments and wherein like reference numerals designate like elements throughout, there is shown in FIG. 1 a side view showing one embodiment of the present invention being used with a table top having a pole extending vertically from the center of the table top to-be-screened.

As shown in FIG. 1, the table screen 1 comprises: (a) a flexible, open screen material 2 having a central aperture 3 sized to fit around the pole 4, with the screen's outer perimeter 5 sized so that its perimeter extends beyond the table top's outer edges 6, (b) a strip 7, located on the perimeter of the screening material's central aperture, of Velcro-like, hook and loop receiving material, with a Velcro-like, hook and loop attaching patch 8 on the opposite side of the strip so that the size of the aperture can be contracted so as to secure the center of the screen material 2 to the pole 4 at a fixed height above the table top 9, (c) a plurality of Velcro-like, hook and loop attaching patches 10 located on the outer perimeter of the screen material and (d) a plurality of table patches 11, each of which has a side for securing the patch to the table top, while the other side has a Velcro-like, hook and loop receiving portion which allows the patches 10 on the screen material's outer perimeter to be adhered to the patches 11 affixed to the table top.

There exist many type of light-weight, flexible screen materials which may be used with the present invention, including those made from nylon and polypropylene mesh.

In other embodiments of the present invention, means other than hook and loop receiving and attaching materials, 7 and 8, may be affixed around the perimeter of the screen material aperture to contract the size of the aperture 3 so that it can be secured so as to set the screen's aperture at a desired height above the table top 9. For example, a drawstring or some type of zipper could be used.

Similarly, other embodiments may employ means other than the hoop and loop patches, 10 and 11, to secure the outer perimeter 5 of the screen material 2 to the table's top 9. For example, many combinations of rope ties and hooks, latches or clamps could be used.

While the embodiment shown in FIG. 1 is for use with a round table, it is clear that the outer perimeter of the screen material may be shaped and sized so as to accommodate table tops having a wide rang of shapes and sizes.

Figure 2:
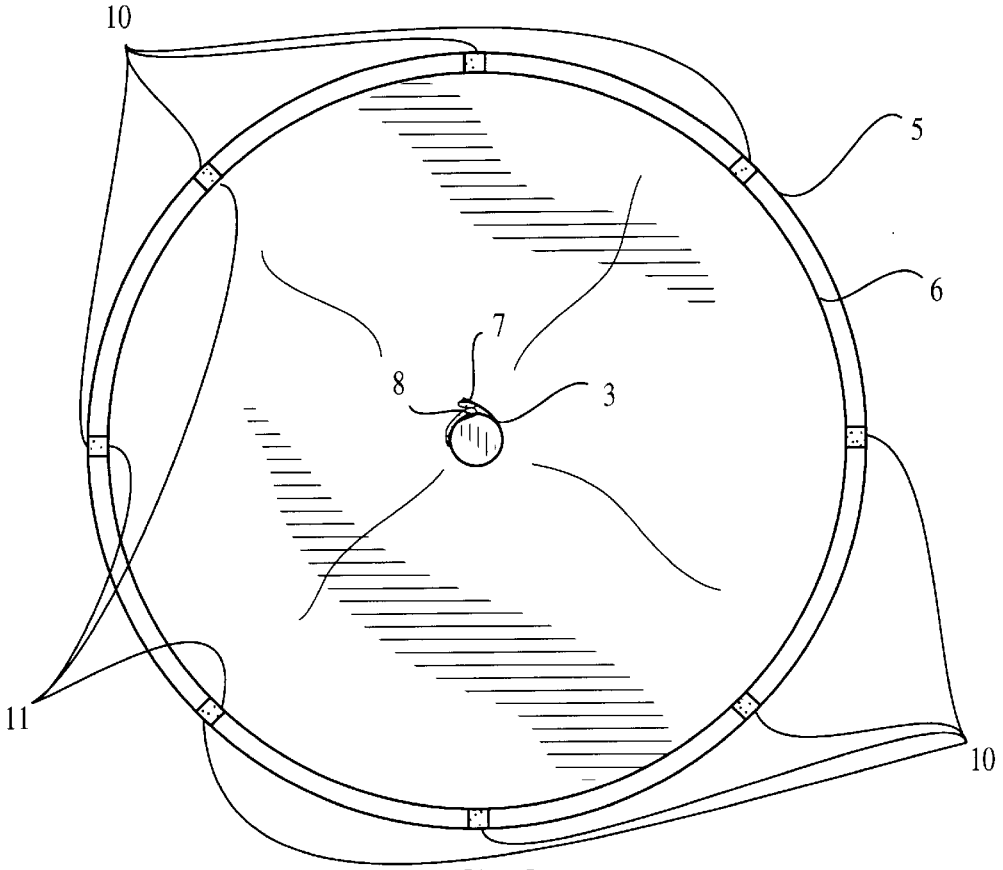
FIG. 2 is a top view of the invention shown in FIG. 1.

FIG. 2 is a top view of the embodiment of the invention shown in FIG. 1 which more clearly shows the tightening of the screen's central aperture to secure the top portion of the screen to the pole and the placement of the hook and loop attaching and receiving patches around the respective perimeters of the screen material and the table top.

Figure 3:
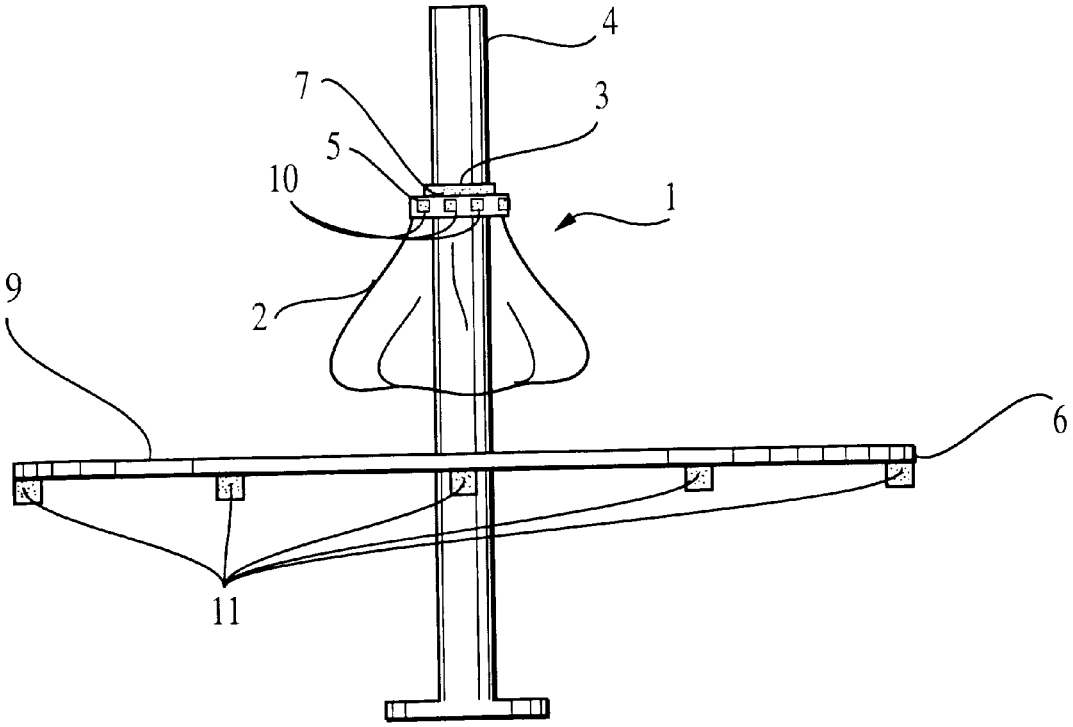
FIG. 3 is a side view of the invention shown in FIG. 1, where the screening material is not in use and has been pulled back and attached to the center pole.

When the screen material needs to be pulled back to unscreen the table's top, FIG. 3 shows how this may be accomplished by attaching the hook and loop patches on the screen's outer perimeter to the hook and loop receiving material on the strip which surrounds the screen's central aperture that is being held at a fixed height above the table's top.

Figure 4:
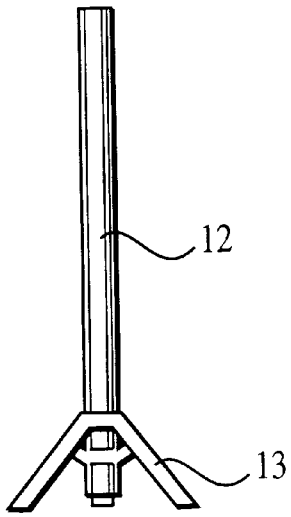
FIG. 4 is a side view of the pole for use with the present invention when the table top to-be-protected does not provide such a pole.

For those situations where it is desired to use the present invention with a table that does not have a central, vertical pole, another embodiment of the present invention further includes a pole and a means for erecting the pole to stand vertically to the table's top. FIG. 4 shows a side view of a suitable pole 12 having retractable struts 13. Many other pole erection means could be used; however, the retractable spokes are especially useful since they allow the pole to be stored in a minimum of space. Additionally, the extendible length of the pole may be increased by utilizing telescoping tubular members and a locking device from which to construct the pole.

In another preferred embodiment, the present invention is seen to take the form of a method for screening a table top. For a table having a pole extending vertically from the table's top, the method comprises the steps of (1) providing a table screen as described above, (2) fixing the screen material's central aperture at a height above the table top so as to define a storage space between the table top and the bottom side of the screen material, (3) adhering the bottom sides of the table patches to the table top, and (4) bringing the Velcro-like, hook and loop attaching patches, located on the outer perimeter of the screen material, into contact with the Velcro-like, hook and loop receiving, top sides of the table patches so as to secure the outer perimeter of the screen material to the table top.

It thus will be appreciated that this new and improved, table screen and table screening method are seen to achieve their object of providing small, easily portable and easily erectable screening devices and methods for keeping bugs and insects away from food and other matter placed on the tops of outdoor tables.

Although the foregoing disclosure relates to preferred embodiments of the invention, it is understood that these details have been given for the purposes of clarification only. Various changes and modifications of the invention will be apparent, to one having ordinary skill in the art, without departing from the spirit and scope of the invention as hereinafter set forth in the claims.

I claim:

1. A table screen for use with a table top having an outer perimeter and a pole extending vertically from the center of the table top, said table screen comprising:

a flexible, open screen material having a central aperture sized to fit around said pole and an outer perimeter sized so that the perimeter of said screen material extends beyond the table top's outer perimeter when the screen material's central aperture is fixed at a height above the table top so as to define a storage space between the table top and the bottom of said screen material, means, located on a perimeter of said screen material aperture, for contracting the size of said aperture so as to secure the center of the screen material to the pole at a fixed height above said table top, and a plurality of means, located on the outer perimeter of the screen material, for: (1) securing the outer perimeter of said screen material to the table top when using the screen material to screen the table and (2) securing the outer perimeter of said screen material to the perimeter of the screen material aperture so as to render the table top fully accessible when the screen material is not being used to screen the table top.

2. A table screen as recited in claim 1, wherein said flexible, open screen material is nylon mesh.

3. A table screen as recited in claim 1, wherein said flexible, open screen material is polypropylene mesh.

4. A table screen as recited in claim 1, wherein:

said means for contracting the size of said screen material aperture comprises a strip of material having an outer surface and an inner surface, said inner surface being defined so that it comes in contact with the outer surface of the pole, said material strip outer surface having a band of hook and loop receiving material and said material strip inner surface having a hook and loop attaching patch, said plurality of means for securing the outer perimeter of said screen material comprising: (a) a plurality of hook and loop attaching patches located on the outer perimeter of the screen material and (b) a plurality of table patches having top and bottom sides, each said table top side patch comprising hook and loop receiving material and each said table bottom side patch having means for securing the table patch to the table top.

5. A table screen as recited in claim 4, wherein said flexible, open screen material is nylon mesh.

6. A table screen as recited in claim 4, wherein said flexible, open screen material is polypropylene mesh.

7. A table screen in combination with a table top having an outer perimeter, said table screen comprising:

a pole having a first end and a second end, means, affixed proximate first pole end, for securing the first pole end to the table top so that the second pole end is extended vertically from said table top, a flexible, open screen material having a central aperture sized to fit around said pole and an outer perimeter sized so that the perimeter of said screen material extends beyond the table top's outer perimeter when the screen material's central aperture is fixed at a height above the table top so as to define a storage space between the table top and the bottom of said screen material, means, located on a perimeter of said screen material aperture, for contracting the size of said aperture so as to secure the center of the screen material to the pole at a fixed height above said table top, and a plurality of means, located on the outer perimeter of the screen material, for: (1) securing the outer perimeter of said screen material to the table top when using the screen material to screen the table top and (2) securing the outer perimeter of said screen material to the perimeter of the screen material aperture so as to render the table top fully accessible when the screen material is not being used to screen the table top.

8. A table screen as recited in claim 7, wherein:

said means for contracting the size of said screen material aperture comprises a strip of material having an outer surface and an inner surface, said inner surface being defined so that it comes in contact with the outer surface of the pole, said material strip outer surface having a band of hook and loop receiving material and said material strip inner surface having a hook and loop attaching patch.

9. A table screen as recited in claim 8, wherein said flexible, open screen material is nylon mesh.

10. A table screen as recited in claim 8, wherein said flexible, open screen material is polypropylene mesh.

11. A table screen as recited in claim 7, wherein said means for securing the pole to the table top comprises a plurality of retractable struts having near and distal ends, said near ends being pivotally attached to said pole so that the strut distal ends may be positioned to touch the table top at points distant from said first pole end to brace the pole.

12. A table screen as recited in claim 8, wherein said means for securing the pole to the table top comprises a plurality of retractable struts having near and distal ends, said near ends being pivotally attached to said pole so that the strut distal ends may be positioned to touch the table top at points distant from said first pole end to brace the pole.

13. A table screen as recited in claim 9, wherein said means for securing the pole to the table top comprises a plurality of retractable struts having near and distal ends, said near ends being pivotally attached to said pole so that the strut distal ends may be positioned to touch the table top at points distant from said first pole end to brace the pole.

14. A table screen as recited in claim 10, wherein said means for securing the pole to the table top comprises a plurality of retractable struts having near and distal ends, said near ends being pivotally attached to said pole so that the strut distal ends may be positioned to touch the table top at points distant from said first pole end to brace the pole.

15. A method for screening a table top having an outer perimeter and a pole extending vertically from the center of the table top, said method comprising the steps of providing a table screen comprising: (a) a flexible, open screen material having a central aperture sized to fit around said pole and an outer perimeter sized so that the perimeter of said screen material extends beyond the table top's outer perimeter, (b) a strip of material, located on the perimeter of the screen material aperture, having an outer surface and an inner surface, said inner surface being defined so that it comes in contact with the outer surface of the pole, said material strip outer surface having a band of hook and loop receiving material and said material strip inner surface having a hook and loop attaching patch, (c) a plurality of hook and loop attaching patches located on the outer perimeter of the screen material and (d) a plurality of table patches having top and bottom sides, each said table top side patch comprising hook and loop receiving material and each said table bottom side patch having means for securing the table patch to the table top, fixing the screen material's central aperture at a height above the table top so as to define a storage space between the table top and the bottom of said screen material, and adhering said bottom sides of the table patches to the table top, and bringing the hook and loop attaching patches, located on the outer perimeter of the screen material, (1) into contact with the hook and loop receiving material on the top sides of the table patches so as to secure the outer perimeter of the screen material to the table top when using the screen material to screen the table top, and (2) into contact with the hook and loop receiving material on the perimeter of the central aperture of the screen material to render the table top fully accessible when the screen material is not being used to screen the table top.

* * * * *